United States Patent [19]

Cobb

[11] 3,946,638

[45] Mar. 30, 1976

[54] LOW RECOIL ANTI-TANK ROCKET LAUNCHER

[75] Inventor: Bernie J. Cobb, Huntsville, Ala.

[73] Assignee: The United States of America as represented by the Secretary of the Army, Washington, D.C.

[22] Filed: Mar. 29, 1974

[21] Appl. No.: 456,408

[52] U.S. Cl. ..... 89/1.806; 89/1.816; 244/3.28

[51] Int. Cl.[2] ..... F41F 3/04; F42B 13/32

[58] Field of Search ..... 244/3.29; 89/1.816, 1.817, 89/1.7, 1.705, 1.806; 102/34.1, 37.1

[56] References Cited

UNITED STATES PATENTS

| | | | |
|---|---|---|---|
| 3,053,184 | 9/1962 | François | 244/3.28 |
| 3,114,287 | 12/1963 | Swaim | 244/3.28 |
| 3,138,064 | 6/1964 | Choate et al. | 89/1.817 |
| 3,177,809 | 4/1965 | Russell-French | 244/3.29 |
| 3,745,876 | 7/1973 | Rocha | 89/1.816 |

*Primary Examiner*—Samuel W. Engle
*Assistant Examiner*—S. A. Cangialosi
*Attorney, Agent, or Firm*—Nathan Edelberg; Robert P. Gibson; Harold W. Hilton

[57] ABSTRACT

A man transportable rocket launcher including a pair of telescoping sections, launch tubes, which are telescoped when being transported and extended for launching of the rocket. The warhead of the rocket always rides on the inner surface of the front tube which is carried inside the rear tube. Retention means cooperate with the fins to assist in retaining the rocket fins in folded position in the launcher prior to rocket launch. The retention means is moveable, with the rocket in the rear tube, for a predetermined length of travel of the rocket at which time the fins are released by the retention means and engaged by the inner surface of the front tube.

3 Claims, 4 Drawing Figures

LOW RECOIL ANTI-TANK ROCKET LAUNCHER

BACKGROUND OF THE INVENTION

Folded fin stabilized rockets have been developed which can be fired by one man from his shoulder or from a light weight portable launcher, if desired. The rockets are extremely useful against tanks when provided with high explosive warheads. Since the launcher must be man-transportable, weight is a prime consideration in such launcher design.

In such launchers, it is desirable to have as long a guidance length as possible, i.e. rocket is in contact with the inner surface of the launcher up to the muzzle. It is also desirable that the launcher have as short a carry length, for transporting thereof, as possible, for a given guidance length. Additionally, recoil must be held to a minimum.

SUMMARY OF THE INVENTION

The rocket launcher of the present invention is disposed for launching rockets having folded fins. Typically, the fins are evenly spaced around the aft end of the rocket and are provided with a curvature, which when the fins are folded, substantially matches the curvature of the rocket's body. The fins are generally spring biased for outward movement when the fins become unrestrained. The launcher includes two launch tubes disposed in telescoping relation. The inner tube is disposed forwardly within the rear launch tube. With the sections extended the warhead of the rocket rides on the inner surface of the front tube. Each fin is provided with a pad secured thereto which is sized to ride on the inner surface of the rear (outer) launch tube section. Responsive to movement of the rocket, the shoes contact the aft end of the front tube and are sheared off to release the fins onto the inner surface of the front tube. Alternatively, a detent sleeve may be positioned in the rear of the launch tube and provided with an internally extending detent for engaging the rocket for retention of the fins in the sleeve, and an externally extending detent for engaging the launch tube. Responsive to ignition of the rocket, the externally extending detent shears and the sleeve moves forwardly in the rocket to engage the aft end of the front tube where upon the rocket engaging detent releases the rocket into the front tube.

DETAILED DESCRIPTION OF THE INVENTION

Figure 1:
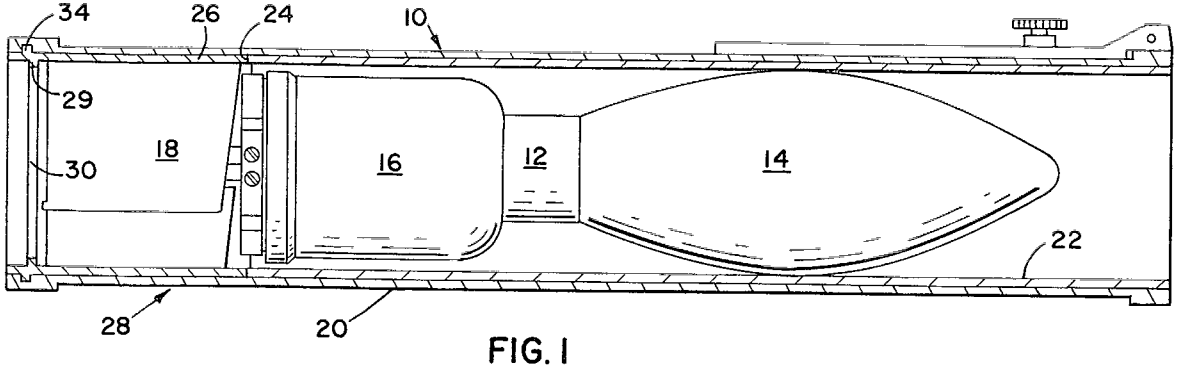
FIG. 1 is an elevational sectional view of the launcher of the present invention in the non-extended position.

As shown in FIG. 1 a rocket launcher 10 is shown to have a rocket 12 carried therein. The rocket 12 includes a warhead section 14, a motor section 16, and fins 18.

The launcher includes a rear launch tube section 20 and a front tube section 22. As shown in FIG. 1 the launch tubes are in nonextended position. In this position the aft end 24 of the front tube is in abutting relation with the forward end of a detent sleeve 26 carried in the aft end 28 of launch tube section 20.

Figure 2:
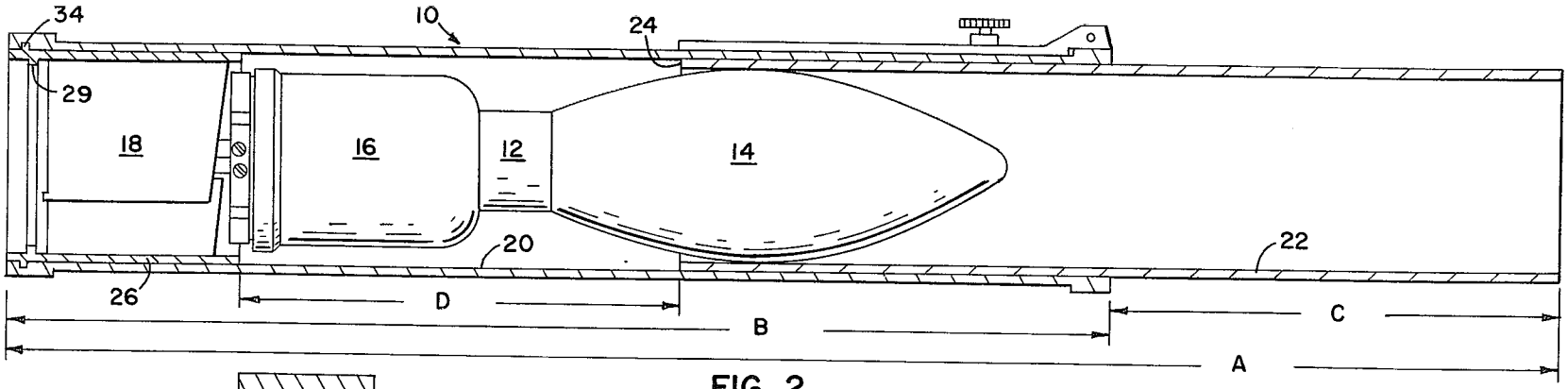
FIG. 2 is an elevational sectional view of the launcher of FIG. 1 in extended position.
Figure 3:
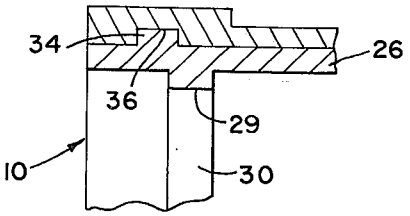
FIG. 3 is an enlarged elevational sectional view of the detent sleeve for engaging the rocket in the launcher.

The launcher is shown in FIG. 2 with the launch tube sections in extended postion and held extended by locking means (not shown). The length of the launch tube assembly in the extended postion is indicated by the dimension A. This is the firing length. The front tube will telescope and result in a carry length B. The warhead always rides on the inner surface of the front tube 22. The minimum telescoping distance is shown as C. There must be sufficient rocket length so that the dimension D is equal to or greater than C. The fins are disposed in folded relation in detent sleeve 26 which is provided with an inwardly extending detent 29 which locks in a groove 30 provided in the rocket (FIG. 3). An externally extending softer detent 34 engages a groove 36 of launcher section 20 to retain the rocket in the launcher section prior to firing thereof.

Upon launch, externally extending detent 34 shears at groove 36 of the launcher and travels with the rocket. When the detent sleeve contacts aft end 24 of the front tube, the sleeve shears loose from the rocket at detent 29 and transfers the fins to the inner surface of the front tube. By adjusting the mass of the detent sleeve (i.e. from simple pads to a heavy sleeve) impulse control can be obtained. Furthermore, having the front tube inside rather than outside as on other launchers reduces the frontal area exposed to exhaust gases and thereby recoil.

Figure 4:
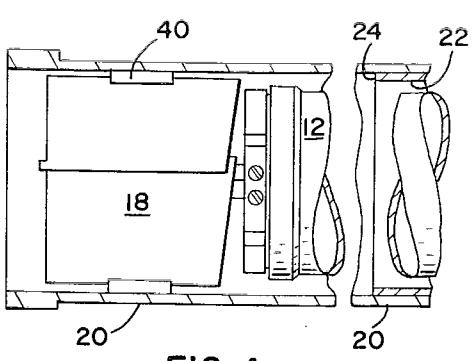
FIG. 4 is a partial sectional view of another embodiment of the invention wherein fin pads are used in place of the detent sleeve.

As shown in FIG. 4 rocket 12 is provided with pads 40 on each of the fins 18 thereof. The pads are sized to ride on the inner surface of the rear tube 20. Responsive to ignition of the rocket the pads will contact the aft end 24 of front tube 22 to be sheared off as a result of the rocket momentum. The fins will then ride the inner surface of the front tube. A separate detent not shown is required when pads are used.

I claim:

1. A lightweight man-transportable rocket launcher disposed for launching a folded fin rocket having a forward warhead section and an aft propulsive section, said launcher comprising:

a. a pair of launch tube members disposed in telescoping relation, the first of said pair of launch tube members defining the rear launch tube section, the second of said pair of launch tube members defining the front section and having an aft surface terminating in said first section, said second of said pair of launch tube members being disposed for movement between a first non-extended position to a second extended position, said pair of launch tube members disposed for carrying said rocket therein so that said forward warhead section rests in said second section of said pair of tube members in either the extended or non-extended position of said launcher;

b. retention means for retaining the fins of said rocket in folded position in said first of said pair of launch tube members and for release of said fins responsive to entrance thereof into said second of said pair of launch tubes, said retention means being disposed about said fins in secured relation with said rocket and disposed for movement therewith and for abutting engagement with said aft surface of said second tubular member and a shearable restraining means for securing said retention means, whereby responsive to said abutting engagement, said restraining means is sheared and said fins released into said second of said pair of tubular members.

2. A rocket launcher as set forth in claim 1 wherein said retention means includes pad members secured to said fins and in engagement with the inner surface of said launch tube.

3. A rocket launcher as set forth in claim 1 wherein said retention means is a sleeve having an outwardly extending detent for engagement with said launcher for retention of said sleeve therein, and an inwardly extending detent for engagement with said rocket for retention of said rocket in said launch tube.

* * * * *